US007194839B2

(12) United States Patent
O'Donnell et al.

(10) Patent No.: US 7,194,839 B2
(45) Date of Patent: Mar. 27, 2007

(54) BRAKE SHOE FOR SASH WINDOW OR DOOR ASSEMBLY

(75) Inventors: Richard H. O'Donnell, Palgrave (CA); Jason L. Annes, Chicago, IL (US)

(73) Assignee: Newell Operating Company, Atlanta, GA (US)

( * ) Notice: Subject to any disclaimer, the term of this patent is extended or adjusted under 35 U.S.C. 154(b) by 0 days.

(21) Appl. No.: 11/116,865

(22) Filed: Apr. 28, 2005

(65) Prior Publication Data

US 2005/0183340 A1 Aug. 25, 2005

Related U.S. Application Data

(63) Continuation of application No. 10/366,753, filed on Feb. 14, 2003, now Pat. No. 6,915,609, which is a continuation of application No. 09/780,917, filed on Feb. 9, 2001, now Pat. No. 6,550,184.

(51) Int. Cl.
*E05D 15/22* (2006.01)

(52) U.S. Cl. ..... 49/181; 49/176

(58) Field of Classification Search ..... 49/176, 49/181, 445, 447; 16/197
See application file for complete search history.

(56) References Cited

U.S. PATENT DOCUMENTS

| | | | |
|---|---|---|---|
| 1,226,145 | A | 5/1917 | Taylor |
| 1,272,039 | A | 7/1918 | Hausmann |
| 1,873,066 | A | 8/1932 | Stewart |
| 2,308,621 | A | 1/1943 | Levyn |
| 2,500,849 | A | 3/1950 | Menns |
| 3,012,292 | A | 12/1961 | Brengman |
| 3,108,335 | A | 10/1963 | Osten, Sr. |
| 3,118,190 | A | 1/1964 | Love |
| 3,146,501 | A | 9/1964 | Peters |
| 3,157,917 | A | 11/1964 | Peters |
| 3,197,819 | A | 8/1965 | Trout |
| 3,348,335 | A | 10/1967 | Mauro |
| 3,399,490 | A | 9/1968 | Hettinger |
| 3,429,071 | A | 2/1969 | Phillips |
| 3,434,236 | A | 3/1969 | Weidner et al. |

(Continued)

*Primary Examiner*—Jerry Redman
(74) *Attorney, Agent, or Firm*—Banner & Witcoff, Ltd.

(57) ABSTRACT

A brake assembly for locking a vertical or horizontal slidable sash window or door within a track of a frame is disclosed. The track has an elongated base and a pair of spaced apart, opposed sidewalls extending perpendicular from the base. Each sidewall has an inner shoulder spaced from and parallel to the base. The assembly has a slider body having a central opening extending from a front face of the body to a rear face of the body. The slider body has a side opening in each side of the slider body and being in communication with the central opening. A pair of brake members are provided wherein one brake member is slidably positioned within a respective one of the side openings. A cam has a rear face and a front face, and is adapted to receive a pivot member mounted on either the sash window or door. The cam is positioned in the central opening and is adapted to be rotatable within the opening by the pivot member. The cam, slider body and brake members include cooperative structure for converting rotary motion of the cam into radial movement of the brake members through the side openings and axial movement of the cam and slider body to lock the brake assembly within the track.

12 Claims, 13 Drawing Sheets

U.S. PATENT DOCUMENTS 3,462,882 A 8/1969 Brown, Jr.
3,466,803 A 9/1969 Packett
3,789,549 A 2/1974 Yip
3,844,066 A 10/1974 Nobes
4,068,406 A 1/1978 Wood
4,222,201 A 9/1980 Yanessa
4,227,345 A 10/1980 Durham, Jr.
4,337,597 A 7/1982 Struckmeyer
4,452,012 A 6/1984 Deal
4,506,478 A 3/1985 Anderson
4,559,739 A 12/1985 Bayer
4,590,708 A 5/1986 Campodonico
4,610,108 A 9/1986 Marshik
4,644,691 A 2/1987 Wright
4,683,675 A 8/1987 Guelck
4,683,676 A 8/1987 Sterner, Jr.
4,718,194 A 1/1988 FitzGibbon et al.
4,813,180 A 3/1989 Scalzi
4,854,077 A 8/1989 Rogers et al.
4,888,915 A 12/1989 Goldenberg
4,922,657 A 5/1990 Foss
4,958,462 A 9/1990 Cross
5,027,557 A 7/1991 May
5,058,321 A 10/1991 Harbom et al.
5,127,192 A 7/1992 Cross
5,168,665 A 12/1992 Goldenberg
5,210,976 A 5/1993 Cripps
5,237,775 A 8/1993 Hardy
5,251,401 A 10/1993 Prete et al.
5,301,467 A 4/1994 Schmidt et al.
5,371,971 A 12/1994 Prete
5,377,384 A 1/1995 Riegelman
5,383,303 A 1/1995 Nakanishi et al.
5,414,960 A 5/1995 O'Donnell et al.
5,632,117 A 5/1997 Prete et al.
5,661,927 A 9/1997 Polowinczak et al.
5,697,188 A 12/1997 Fullick et al.
5,704,165 A 1/1998 Slocomb et al.
5,802,767 A 9/1998 Slocomb et al.
5,806,243 A 9/1998 Prete et al.
5,829,196 A 11/1998 Maier
5,927,014 A 7/1999 Goldenberg
5,943,822 A 8/1999 Slocomb et al.
6,032,417 A 3/2000 Jakus et al.
6,058,653 A 5/2000 Slocomb et al.
6,119,398 A 9/2000 Yates, Jr.
6,161,335 A 12/2000 Beard et al.
6,550,184 B1 4/2003 O'Donnell et al.
6,679,000 B2 1/2004 Uken et al.
6,886,295 B2 * 5/2005 Annes et al. ..... 49/181

* cited by examiner 10
62
63
64
68
60
76
78
70
74
80
51
32
27
14
44
30
21
33
36
34
35
38
38
40
42
57
48
57
46
43

21
51
28
51
32
30
44
14
34
35
36
11
54
42
58
57
40
56
42
48
46
57
48

FIG. 8
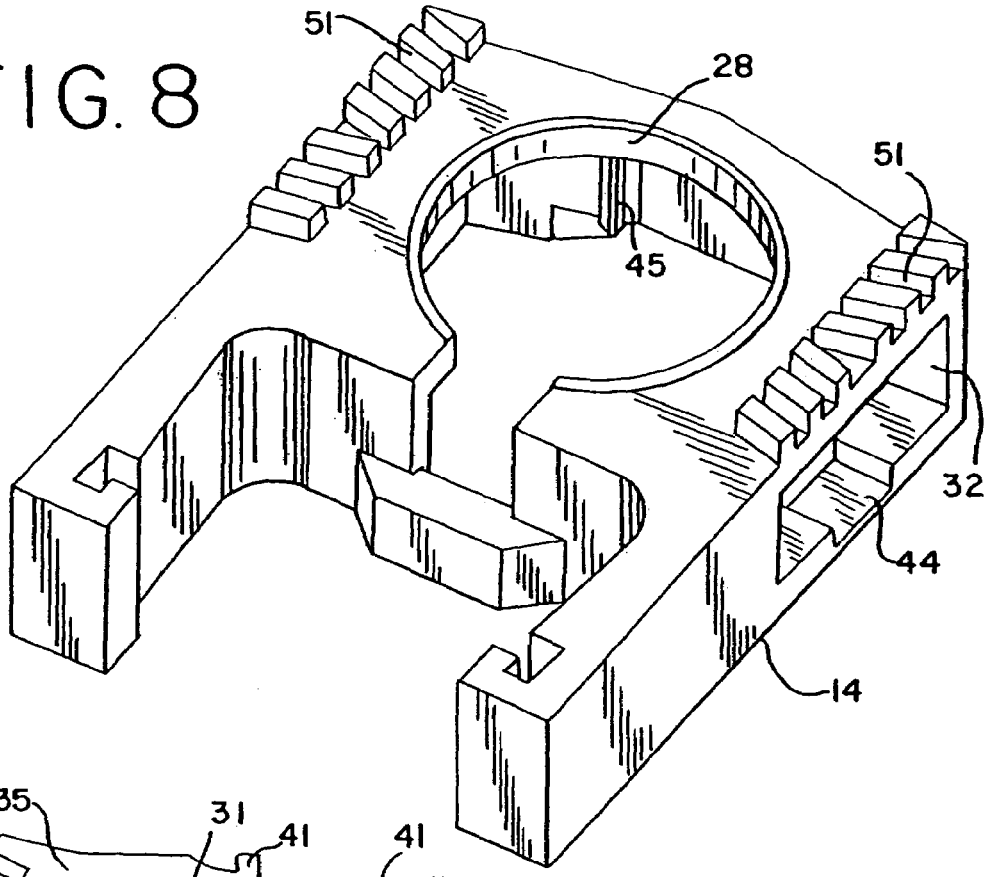
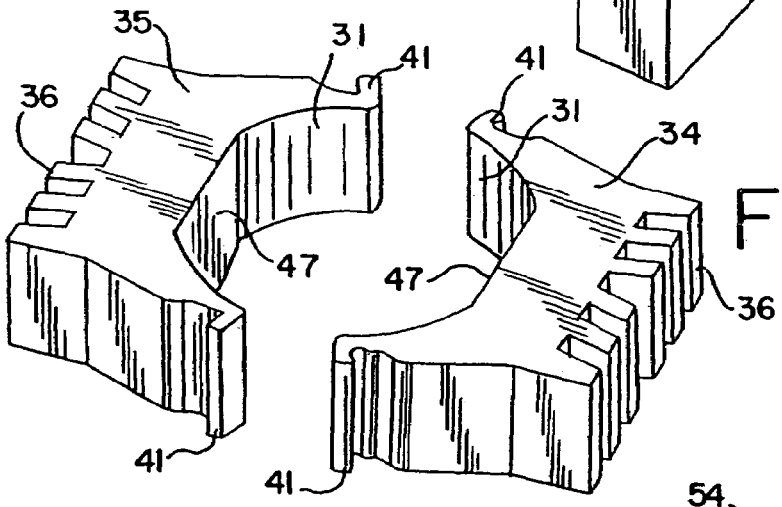
FIG. 9
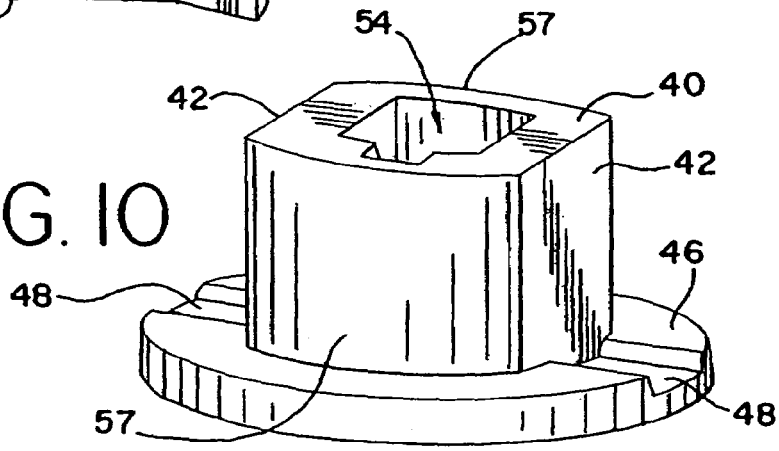
FIG. 10

FIG. 20
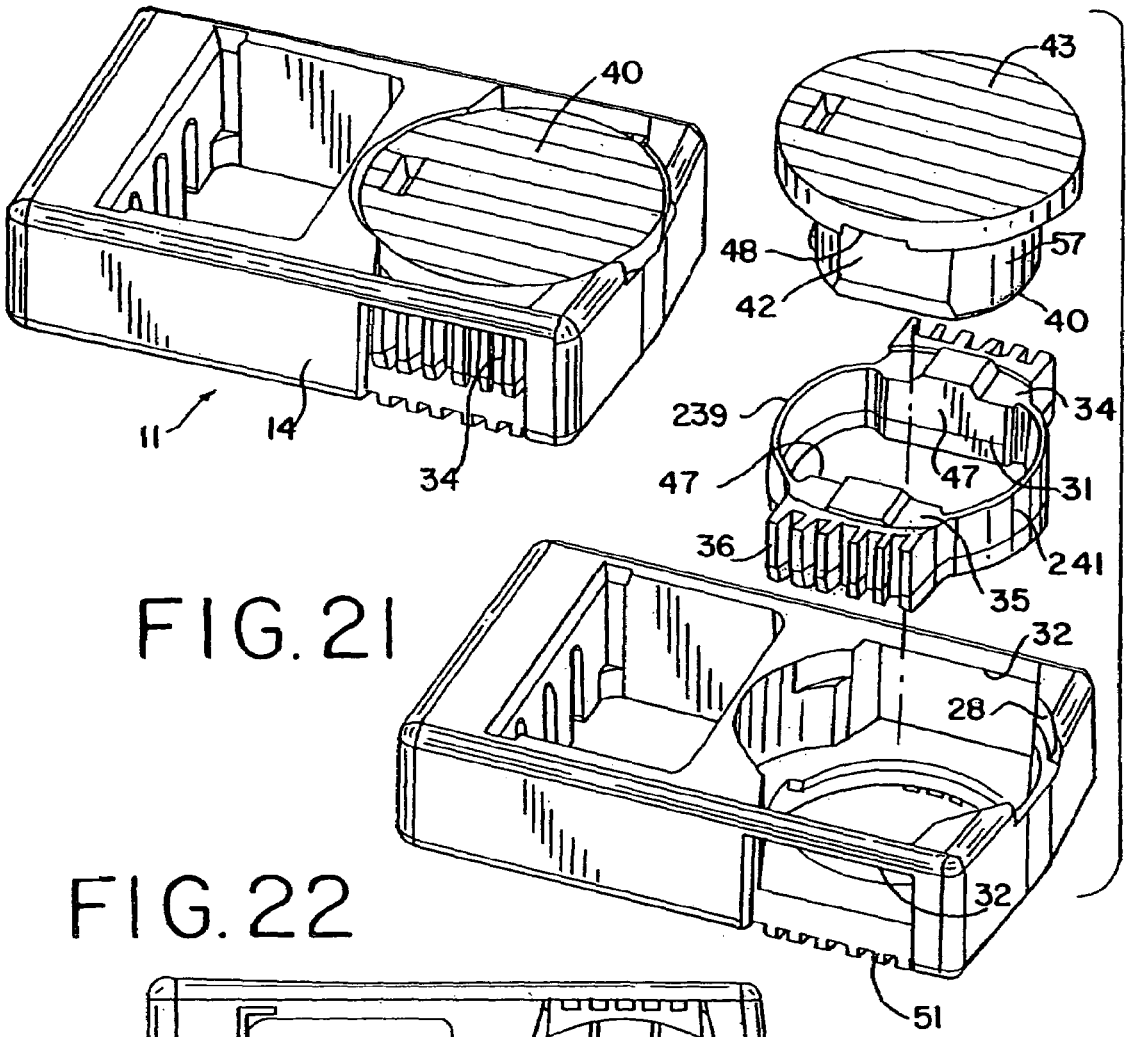
FIG. 21
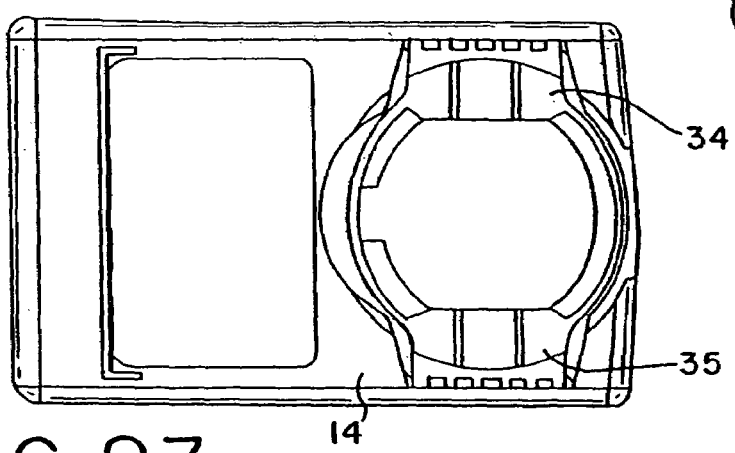
FIG. 22
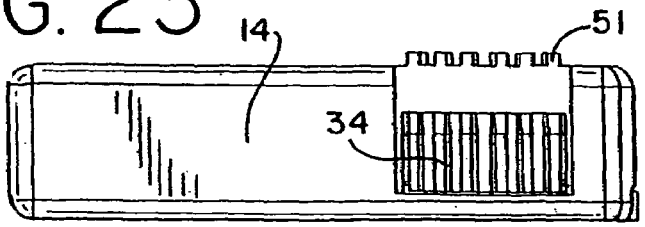
FIG. 23

BRAKE SHOE FOR SASH WINDOW OR DOOR ASSEMBLY

CROSS-REFERENCE TO RELATED APPLICATIONS

This application is a continuation application of and claims the benefit of co-pending U.S. application Ser. No. 10/366,753, filed Feb. 14, 2003 now U.S. Pat. No. 6,915,609, which is a continuation of U.S. application Ser. No. 09/780,917, filed Feb. 9, 2001, now U.S. Pat. No. 6,550,184, which are incorporated by reference herein and made a part hereof.

FEDERALLY SPONSORED RESEARCH OR DEVELOPMENT

Not applicable.

TECHNICAL FIELD

This invention relates to a pivoting and sliding device for slidable door or window assemblies mounted in a frame. More particularly, it relates to a pivoting and sliding device having cam activated locking mechanisms that are activated when pivoting a slidable door or window out of the plane of the frame.

BACKGROUND OF THE INVENTION

It is known in the prior art of slidable window sash and frame construction to have vertical and horizontal sliding windows adapted to be pivoted out of the frame when desired. For tasks such as cleaning the window from within the building in which the window is installed, a pivoting window must be securely arrested from sliding at the pivot point to prevent sagging or complete dislodging of the sash from the frame.

Pivot mechanisms have included movable pins mounted on the edge of the sash which may be extended outwardly to engage holes in the frame about which the sash may be pivoted. U.S. Pat. No. 4,222,201 discloses a pivoting mechanism wherein a pair of spring biased pins are manually extended outward. Mating apertures in the tracks receive the pins, providing an axis of rotation. The sash may then be pivoted. After the window is pivoted back into the plane of the frame, the pins are retracted and secured in place by a screw to allow the sash to freely slide within the frame.

U.S. Pat. No. 5,058,321 discloses a mechanism wherein spring biased pivot pins are freed for selective extension into apertures formed in a frame by rotating said pins. The pins are retracted by rotation and secured in place by an arrangement of detents.

It is also known in the prior art to provide a pivoting arrangement which achieves automatic arresting of the sliding motion of a slider body in a track in response to the commencement of the pivoting of the window sash. U.S. Pat. No. 4,610,108 discloses such a device which incorporates a generally U-shaped spring member within a block, wherein a pin or strut extending from a window sash is connected. A cam member is incorporated in the block member which is rotatably engagable with the U-shaped member to lock the block in position upon pivoting the window sash. Although simple to operate, experience has shown that a pivot arrangement of this type may not develop adequate arresting strength and reliability.

U.S. Pat. No. 5,414,960 discloses a cam and frictional locking assembly in which rotation of the cam in a sliding block, slidably mounted within a track, produces lateral, or radial expansion and normal, or axial biasing of the slide block to frictionally engage four sides of the slide block with respective opposing track surfaces.

SUMMARY OF THE INVENTION

According to a first aspect of the invention, a sash balance brake assembly is disclosed for locking a slidable sash window or door within a track of a frame, the track having an elongated base and a pair of spaced apart, opposed sidewalls extending perpendicular from the base, each sidewall having an inner shoulder spaced from and parallel to the base. The assembly has a slider body having a central opening extending from a front face of the body to a rear face of the body, a pair of side openings in the slider body being in communication with the central opening. A brake member is slidably positioned within each side opening. A cam is provided having a rear face and a front face adapted to receive a pivot member mounted on either the sash window or door. The cam is positioned in the central opening and adapted to be rotatable within the opening by the pivot member for radially biasing the brake members for movement through the side openings wherein the brake members are adapted to frictionally abut the opposed sidewalls and for axially biasing the cam and slider body for axial movement wherein the rear face of the cam is adapted to frictionally abut the elongated base of the track and the front face of the slider body is adapted to frictionally abut the inner shoulders to lock the slider body from slidable travel in the track.

According to another aspect of the invention, radial movement of the brake members and axial movement of the cam and slider body occur substantially simultaneously. In addition, the frictional abutment of the brake members with the sidewalls and the frictional abutment of the cam against the elongated base and slider body against the shoulders occur substantially simultaneously.

According to a further aspect of the invention, the slider body, brake members and cam are provided with frictional surfaces.

According to another aspect of the invention, the brake members are connected by a resilient flexible membrane.

Other features and advantages of the invention will be apparent from this specification taken in conjunction with the following drawings.

BRIEF DESCRIPTION OF THE DRAWINGS

The pivoting and sliding device of the invention will now be described with reference to the accompanying drawings, in which:

FIG. 8 is a perspective view of a slide block of the brake shoe assembly;

FIG. 9 is a perspective view of radial brake members of the brake shoe assembly;

FIG. 10 is a perspective view of a cam mechanism of the brake shoe assembly;

FIG. 20 is a perspective view of the rear of a second preferred embodiment of the brake shoe assembly of the invention;

FIG. 21 is an exploded perspective view of the second preferred embodiment of the brake shoe assembly of the invention;

FIG. 22 is a front plan view of the second preferred embodiment of the brake shoe assembly of the invention;

FIG. 23 is a side view of the second preferred embodiment of the brake shoe assembly of present invention;

DETAILED DESCRIPTION

Figure 1:
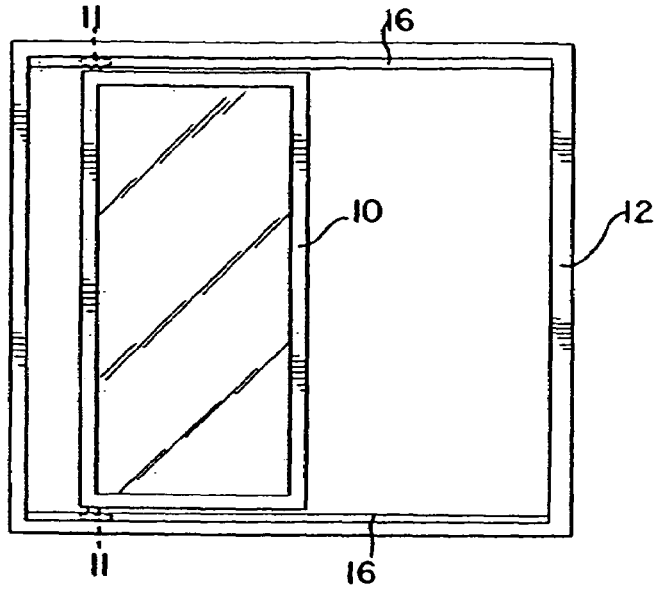
FIG. 1 is a front elevation of a horizontally slidable sash and frame incorporating the brake shoe assembly device of the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 2:
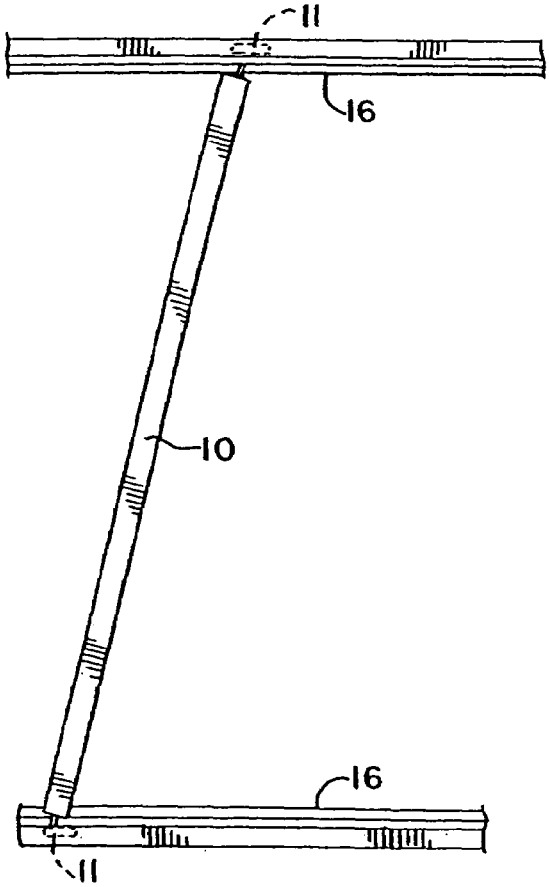
FIG. 2 is a front elevation of a horizontally slidable sash and frame showing installation and removal of the sash.
Figure 3:
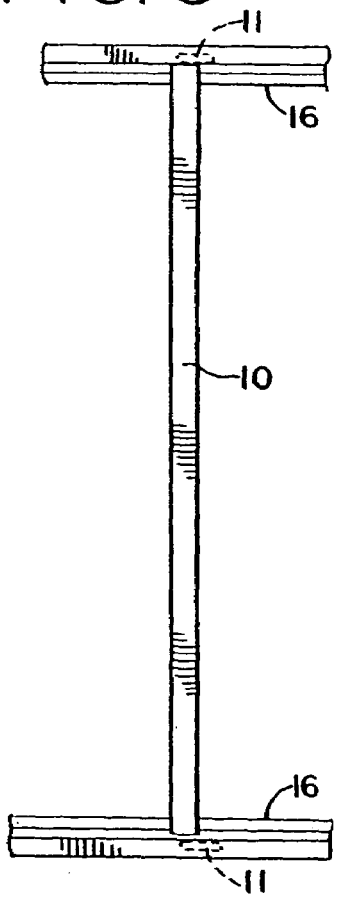
FIG. 3 is a partial front elevation of the sash and frame utilizing the present invention showing the sash pivoted perpendicular to the frame.
Figure 4:
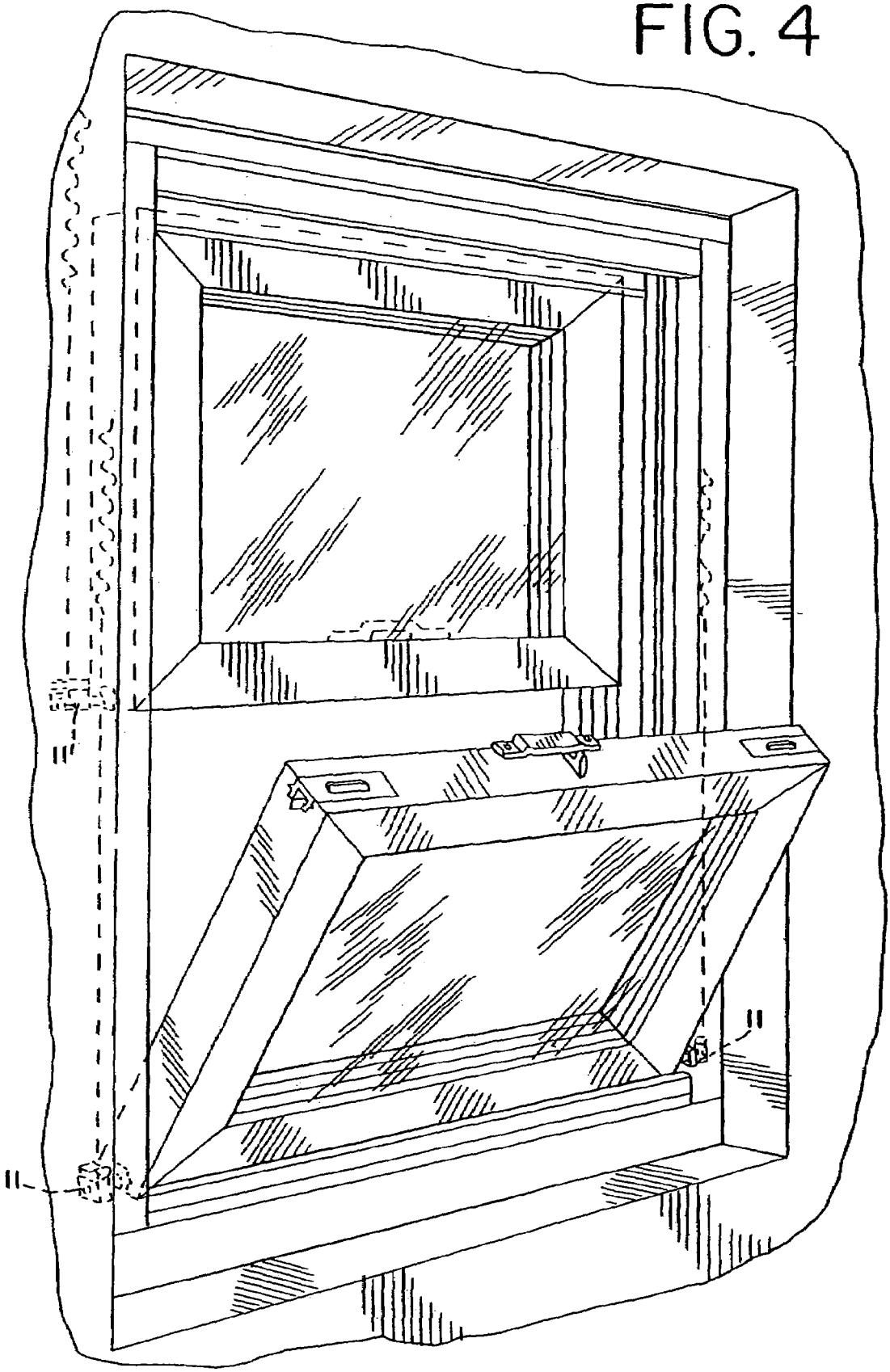
FIG. 4 is a front elevation of a double-hung vertically sliding window assembly incorporating the device of the present invention.

Referring now to FIG. 1 of the drawings, there is shown a slidable window generally designated by numeral 10 and a window frame 12. It is understood that the window assembly could also be a door assembly wherein a slidable door is positioned within a door frame. Brake shoe assemblies 11 are mounted in parallel opposed tracks 16 to provide normal sliding motion of the sash 10 in frame 12. As shown in FIG. 3, the sash 10 is adapted to pivot out of the plane of the frame 12 about a vertical axis through the brake shoe assemblies 11. While FIGS. 1–3 show a horizontal window assembly, the invention can also be utilized in a vertical window assembly such as the double-hung window assembly shown in FIG. 4. It is further understood that the invention is not limited to either horizontally or vertically sliding sashes, but also relates to any other sliding member within a frame.

Figure 5:
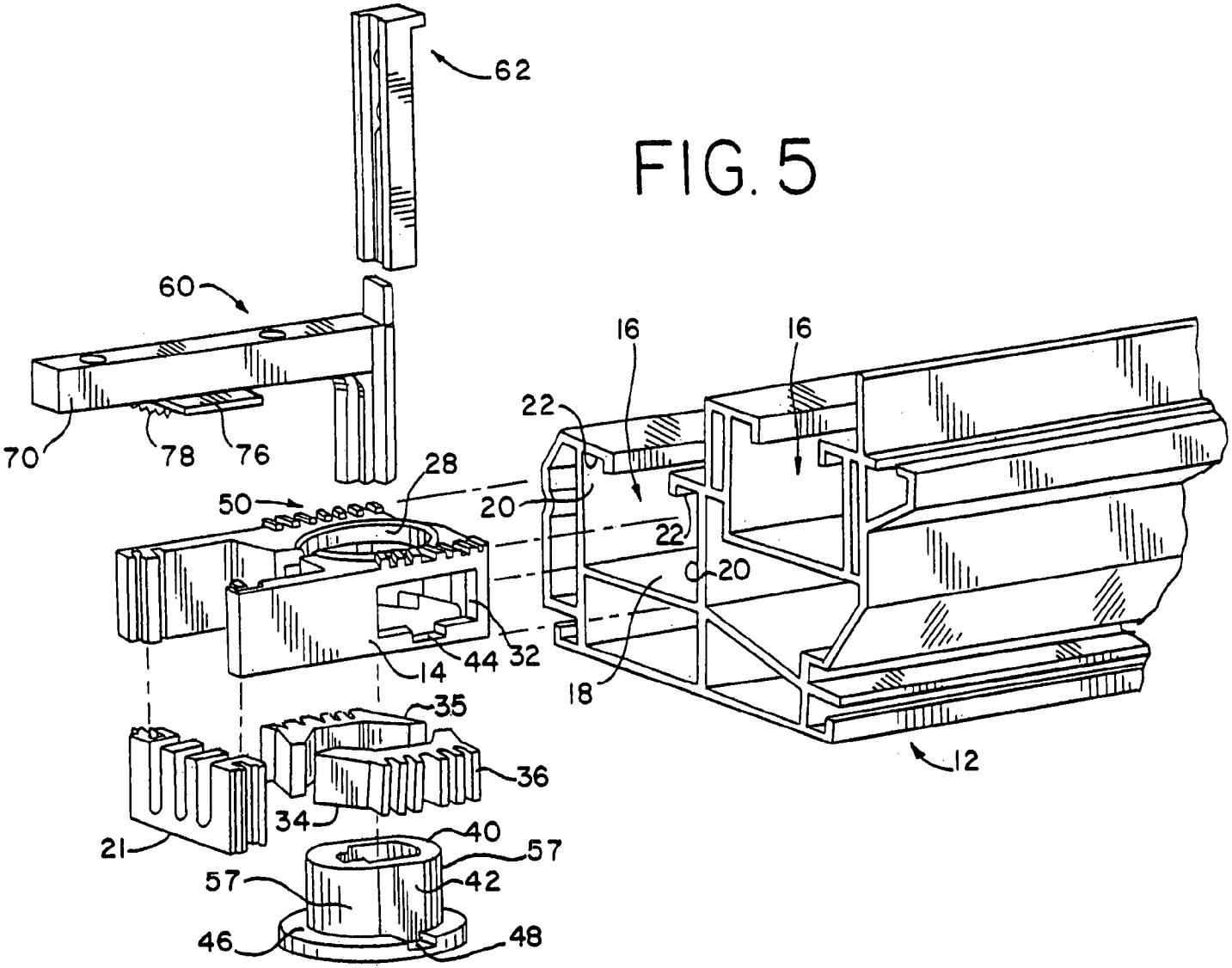
FIG. 5 is an exploded perspective view of a brake shoe assembly, pivot bar and a brake shoe track.

Now referring to FIG. 5, a partial perspective view of the frame 12 is shown having a pair of integral parallel tracks 16 formed therein into one of which a slider body 14 may be slidably mounted. The frame 12 may be formed of aluminum or plastic in an extrusion process or other suitable manufacturing method. Significant components of the track 16 include an elongated base 18 and a pair of opposed, spaced apart sidewalls 20 substantially parallel to one another and generally perpendicular to the elongated base 18. Each sidewall 20 has an inwardly facing shoulder 22, substantially parallel to the opposed elongated base 18. The function and importance of the track configuration as described herein will become evident as the description continues.

Figure 19:
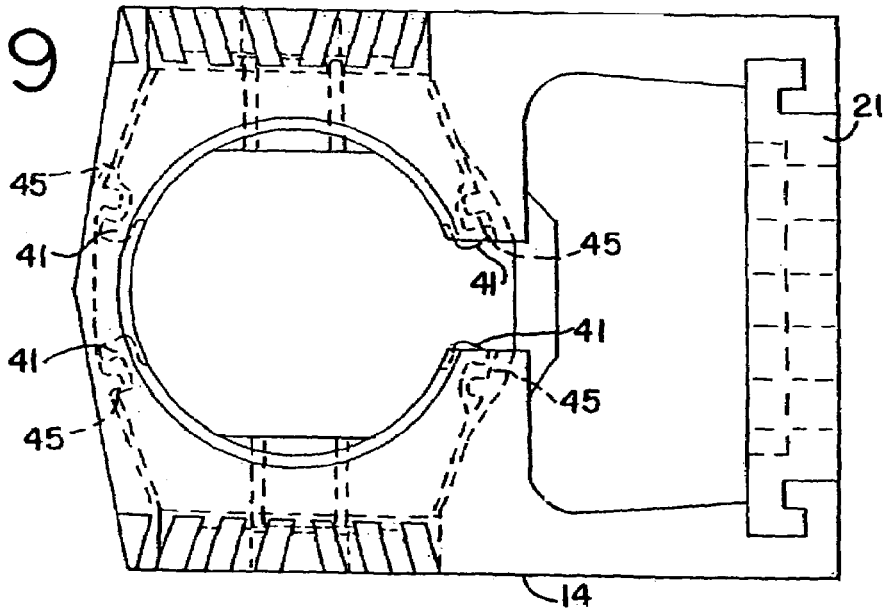
FIG. 19 is a rear view of the brake shoe assembly.
Figure 24:
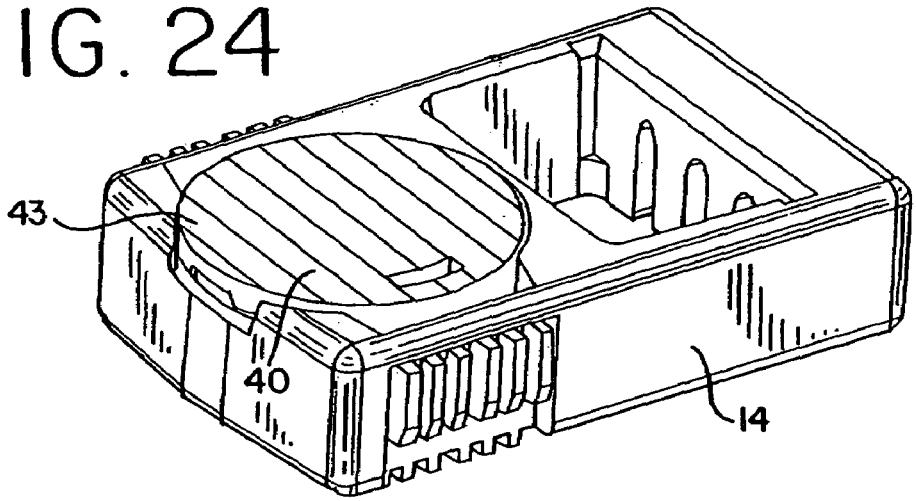
FIG. 24 is a perspective view of the rear of the second preferred embodiment of the brake shoe assembly of the present invention showing the radial brake members extended beyond the outer surface of the brake shoe.
Figure 25:
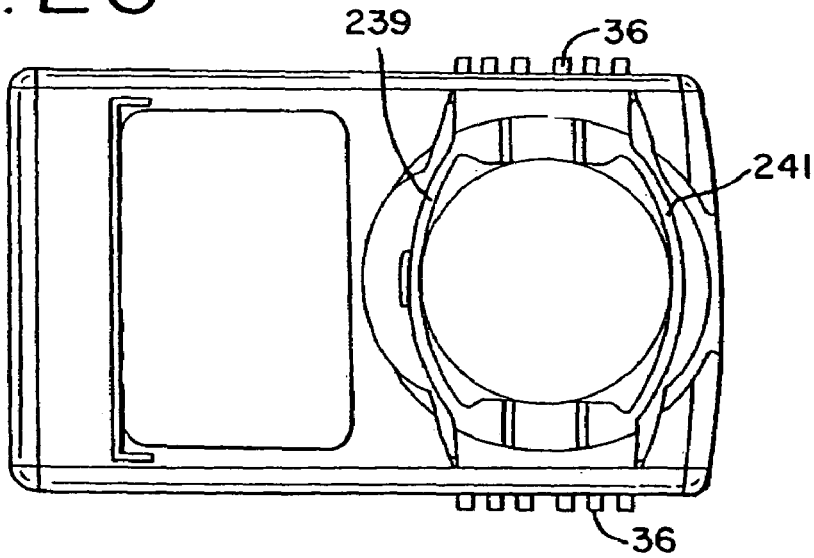
FIG. 25 is a front view of the brake shoe assembly of the second preferred embodiment of the present invention.
Figure 26:
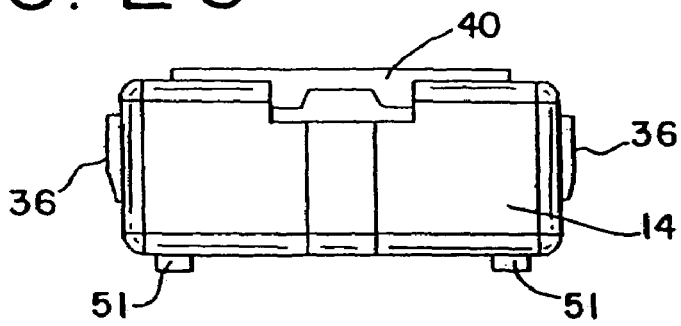
FIG. 26 is an end view of the brake shoe assembly of the second preferred embodiment of the present invention showing the radial brake members extended beyond the outer surface of the brake shoe.

A detailed construction of a brake shoe assembly 11 of the present invention is shown in FIGS. 5–10. The brake shoe assembly 11 generally includes a slider body 14, a cam mechanism 40, and brake members 34,35. The slider body 14 has outside dimensions contoured to fit within the track 16 as described above. Slider body 14 preferably is manufactured from a tough material such as nylon. The slider body 14 has a central opening 28 in proximity to an end 27. The central opening 28 extends from a front face of the body 14 to a rear face of the body 14. The end of slider body 14 distal from end 27 is adapted to receive insert 21 (FIG. 6) which is capable of connection to a means of providing counter balance weight for assisting in the sliding of sash 10 when, for example, the invention is utilized with a vertically sliding sash 10 such as in a conventional double hung window as that shown in FIG. 4. Side or radial openings 32,33 are formed in sidewalls of the slider body 14 and are in communication with the central opening 28. The side openings 32,33 receive radial or lateral brake members 34,35 for reciprocal lateral travel. Brake members 34,35 have protrusions 38 formed in an underside rear side thereof and the radial or side openings 32,33 have a slot 44 to accommodate the protrusion 38. As shown in FIG. 19, the slider body 14 has two pairs of protuberances 45 that are preferably integrally formed with the slider body 14 and extend into the central opening 28. The slider body 14 is adapted to accept different inserts 21 at its upper portion. The inserts accommodate different types of balance systems.

Different types of balance systems have different connecting structures. Thus, with the use of inserts 21, a single slider body 14 can accept any of the different balance systems.

Referring to FIGS. 5, 6, 7 and 9, the brake members 34,35 are generally u-shaped. The inner surface 31 of each brake member 34 has a centrally located substantially planar or flat surface or portion 47. The flat surface 47 confronts the cam mechanism 40 as described in greater detail below. Integrally formed in brake members 34 are lips 41. Each brake member 34,35 preferably has a pair of lips 41 at opposite ends. Radial brake members 34,35 are adapted such that lips 41 cooperate with the protrusions 45 as will be described in greater detail below. The brake members 34 also have outer braking surfaces such as frictional ribbed surfaces 36. The frictional ribs 36 can be formed into two groups that extend away from one another, or merely be formed in generally parallel relation. In one preferred embodiment of the invention, the frictional ribs 36, have serrated ends as shown in FIG. 19, to further improve their friction engaging properties.

As shown in FIGS. 5–7, 10 and 15–17, the cam mechanism 40 is adapted to rotate and axially move in the central opening 28 in the slider body 14. The outer surface of the cam 40 has two diametrically opposite flats or flat portions 42 and two generally circular portions 57. The cam mechanism 40 also has a circular flange 46 preferably integrally formed therewith. The flange 46 of the cam mechanism 40 has a pair of diametric recesses 48 on a base surface of the flange 46. The recesses 48 receive protuberances 38 positioned on the brake members 34,35. The flange 46 is adapted to fit in close abutment against a shoulder 30 (FIG. 6) of the slider body 14. The cam mechanism 40 is further adapted such that flats 42 fit in close abutment with planar surfaces 47 of the brake members 34,35. The underside of cam mechanism 40 has a plurality of elongated ridges or cam base friction ribs 43 extending across its planar underside. When the cam mechanism 40 is rotated, cam action produces both lateral expansion of radial brake members 34,35 and vertical or axial biasing of the slider body 14 to lock slider body 14 in track 16, resulting in four-way breaking as will be described in greater detail below.

As shown in FIGS. 5–8 and 15, slider body 14 also includes friction engaging means 50 such as substantially transverse friction ribs 51 extending from a front or upper surface of the slider body 14. The ribs 51 slide in close abutment with the track inwardly facing shoulders 22. As depicted, the ribs 51 are comprised of two groups positioned at converging angles with respect to one another. Alternatively, the ribs 51 could be positioned in substantial parallel relation. When brake members 34,35 are expanded laterally or radially and the slider body 14 is biased axially, the outer braking surfaces 36, are pressed tightly against the opposed track side walls 20 and the friction ribs 50 and cam base friction ridges 43 are pressed tightly against the opposed shoulders 22 and elongated base 18 respectively. The brake shoe assembly 11 is then frictionally arrested against movement of the slider body 14 within track 16 via four-way breaking.

Referring now to FIGS. 5–7 and 10, cam mechanism 40 includes an elongated axial opening 54, centrally located, having a rectangular keyway 56 at one side opposing an arcuate surface 58. An upwardly extending pivot means 60, or pivot member or bar 60, for joining sash 10 to slider body 14 is mounted within the opening 54 of cam mechanism 40, adapted to fit in close abutment with the keyway 56. The upper extension of the pivot member 60 has longitudinal ribs 68 configured to receive mating slotted surface 64 of locking tab 62. The sliding of locking tab 62 downward, such that the locking tab lower extension 63 enters the opening 54 in close and mating abutment with the arcuate surface 58, tightly engages pivot means 60 in keyway 56 of opening 54. Locking tab 62 is secured to pivot means 60 by a bolt and lock nut (not shown). Extension 70 of the pivot means 60 is securely fastened to the underside of sash 10 in recess 74, such as with two screws (not shown) or any other known connection means. While the pivot bar 60 is shown as a separate structure that is releasably connected to the sash 10 and cam mechanism 40, it is understood that the pivot bar 60 may be integral with the sash 10. It is further understood that other pivot members 60 could be utilized with the brake shoe 11.

Figure 6:
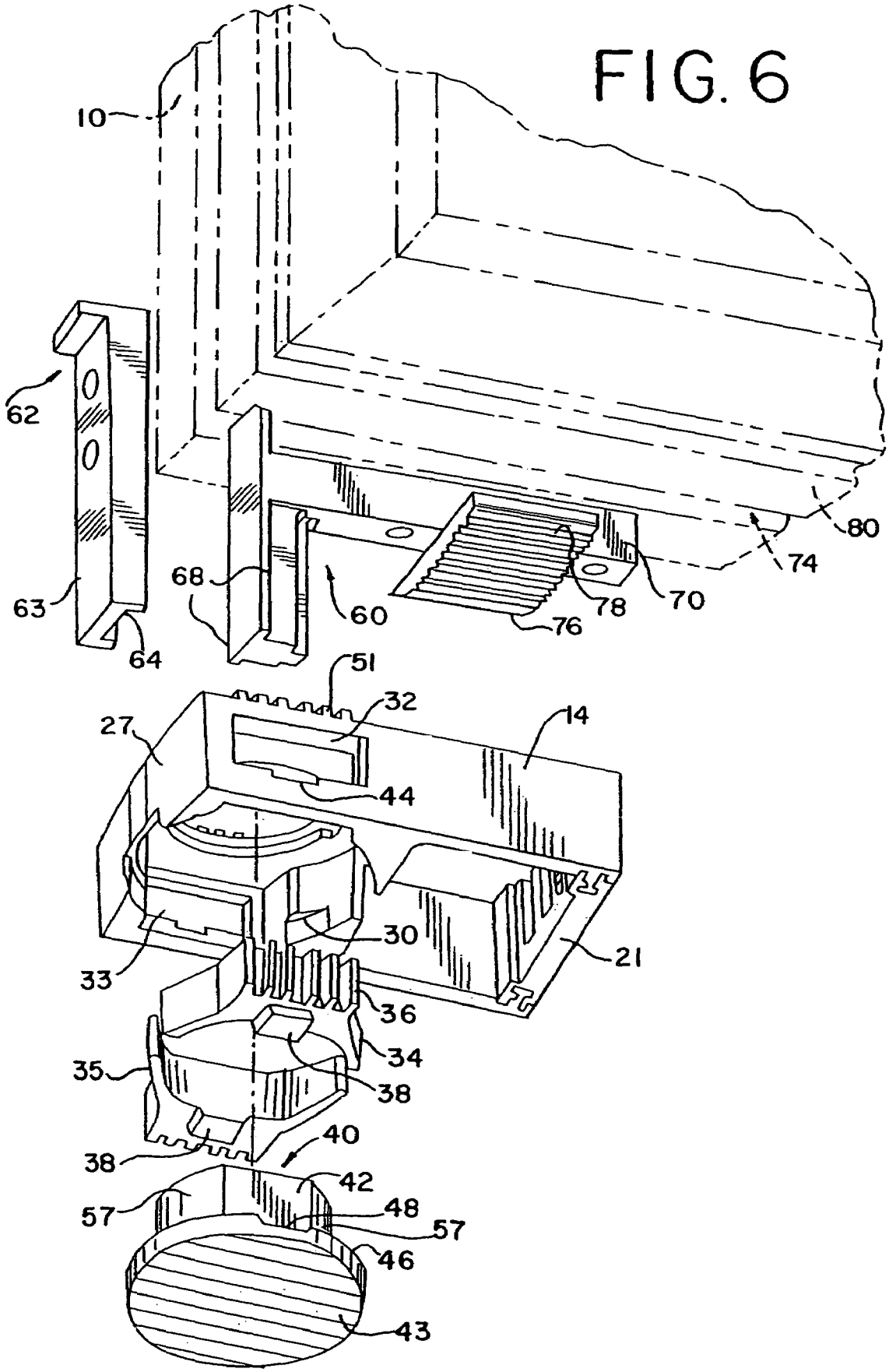
FIG. 6 is an exploded perspective view of the brake shoe assembly and pivot bar as seen from below, with a sash shown in phantom lines.
Figure 7:
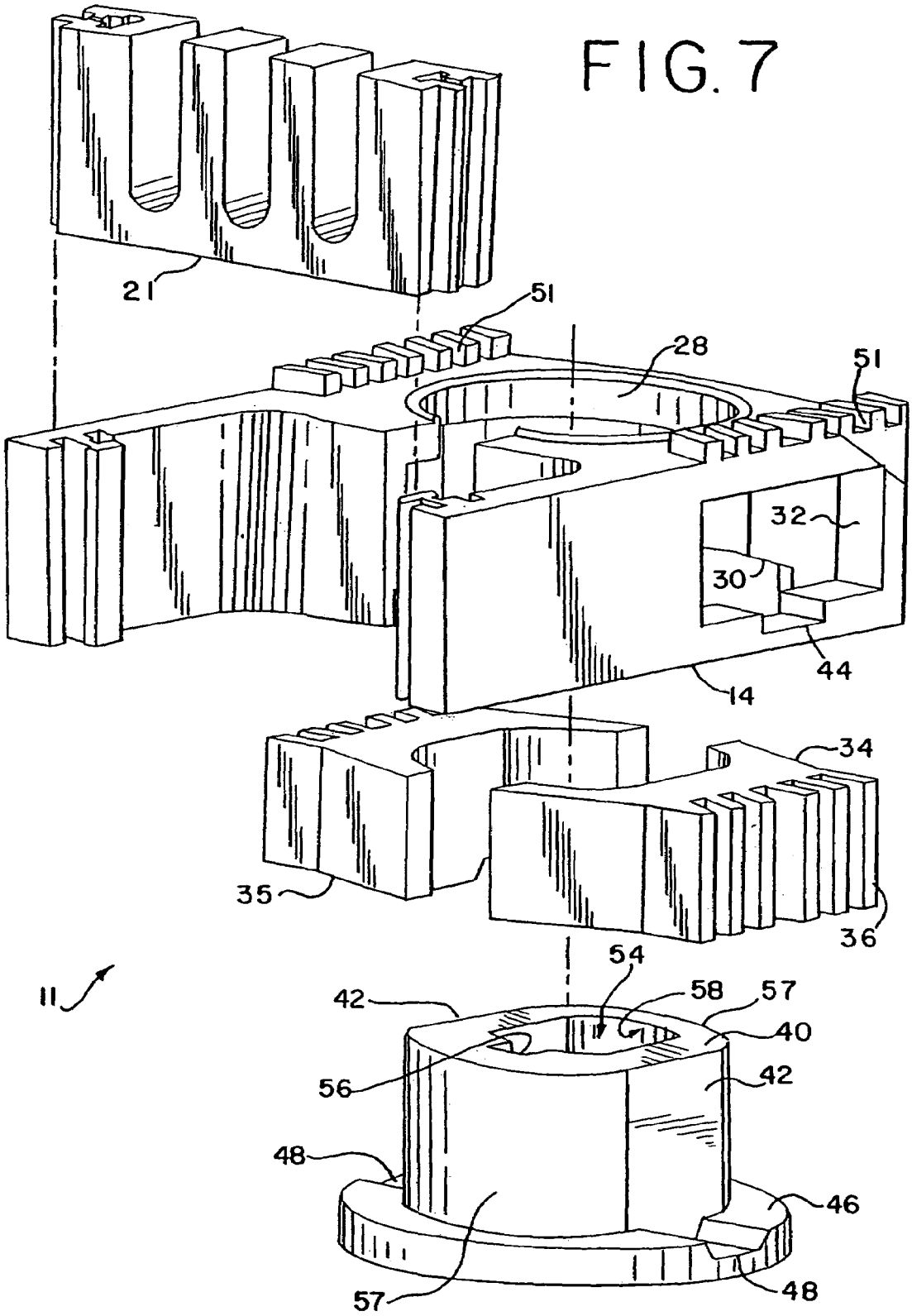
FIG. 7 is an exploded view of the brake shoe assembly.

As shown in FIG. 6, a friction pad 76, consisting of a plurality of elongated ribs 78 is mounted to the underside of horizontal arm 70 of pivot means 60 via any suitable known attachment means, such that elongated ribs 78 extend from horizontal arm 70 towards the shoe track 16 when the sash 10 is in its slidable position. Sash 10 has surfaces 80 adjacent to tracks 16 when sash 10 is in its slidable position. Additional friction pads 76 are mounted to surfaces 80 by any known suitable attachment means such that their elongated ribs 78 extend towards the track 16 when sash 10 is in its slidable position.

Figure 11:
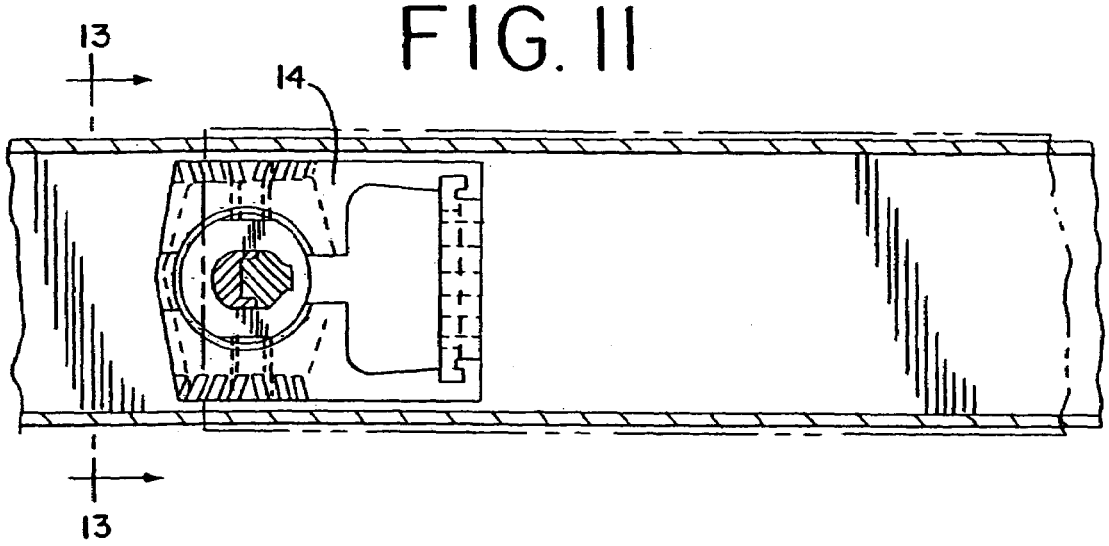
FIG. 11 is a plan view of the brake shoe assembly in a shoe track wherein the sash, depicted by phantom lines, is in a normally planar position.
Figure 13:
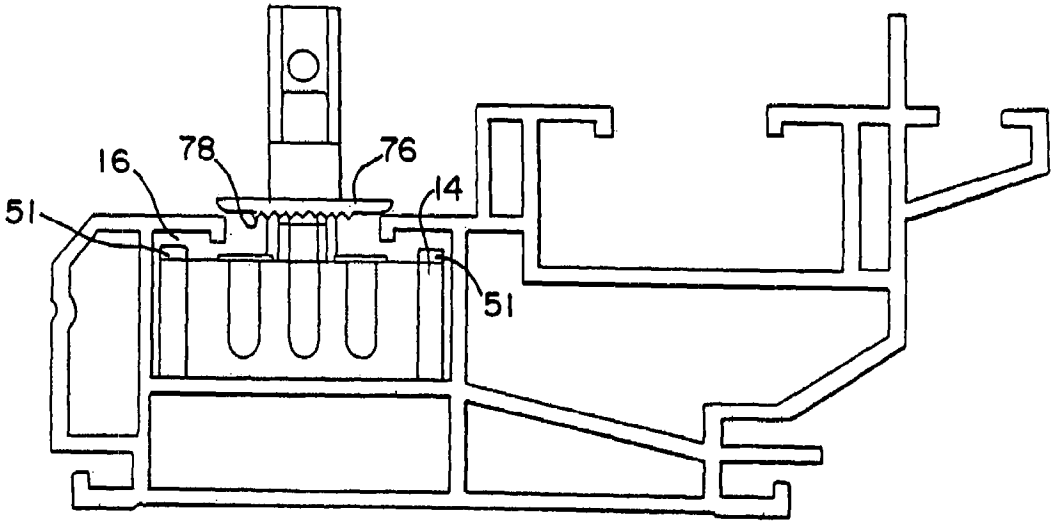
FIG. 13 is a vertical cross section taken through line 13—13 of FIG. 11 showing the brake shoe assembly in a non-actuated position and also showing additional sash frame construction.

In operation, window or door sash 10 freely slides horizontally or vertically in frame 12. When the sash 10 is freely slidable, the flat portions 42 of the cam 40 are adjacent to the flat portions 47 of brake members 34 and the recesses 48 receive the protrusions 38 of brake members 34,35. The brake members 34,35 and cam 40 are positioned generally within the slider body 14. This is defined as a free-sliding window or door position, such as shown in FIGS. 11 and 13.

Figure 12:
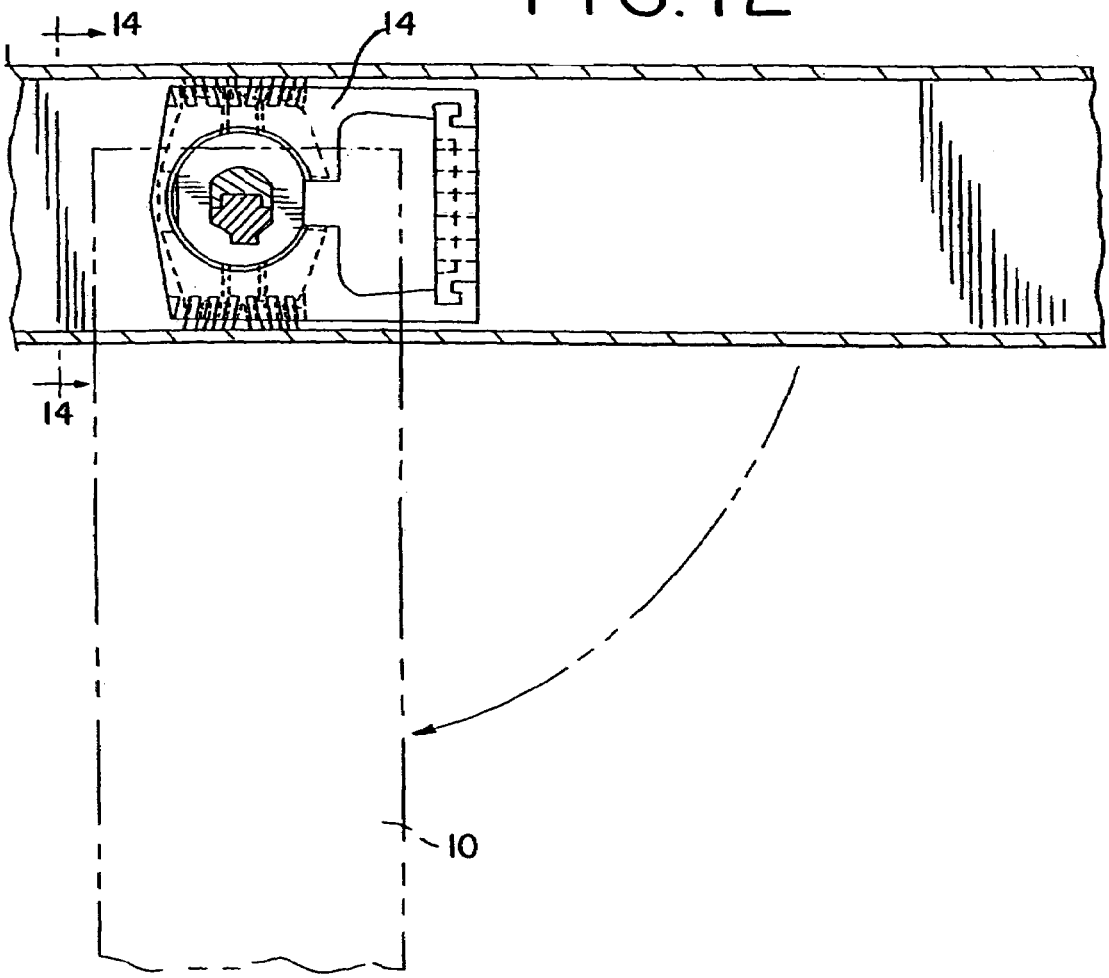
FIG. 12 is a plan view of the brake shoe assembly with the sash, depicted by phantom lines, pivoted 90° out of the plane of the frame, showing the brake shoe assembly in an actuated position.
Figure 14:
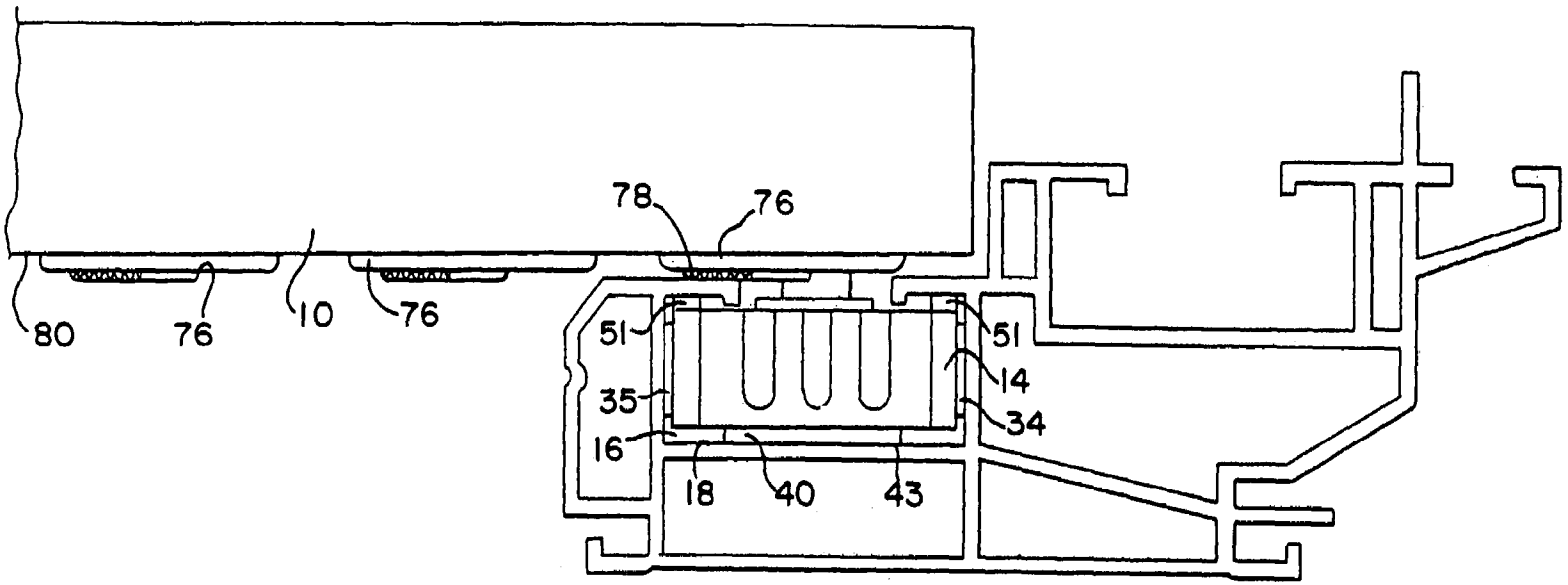
FIG. 14 is a partial vertical cross section taken through line 14—14 of FIG. 12 showing the brake shoe assembly in an actuated position and also showing additional sash frame construction.
Figure 18:
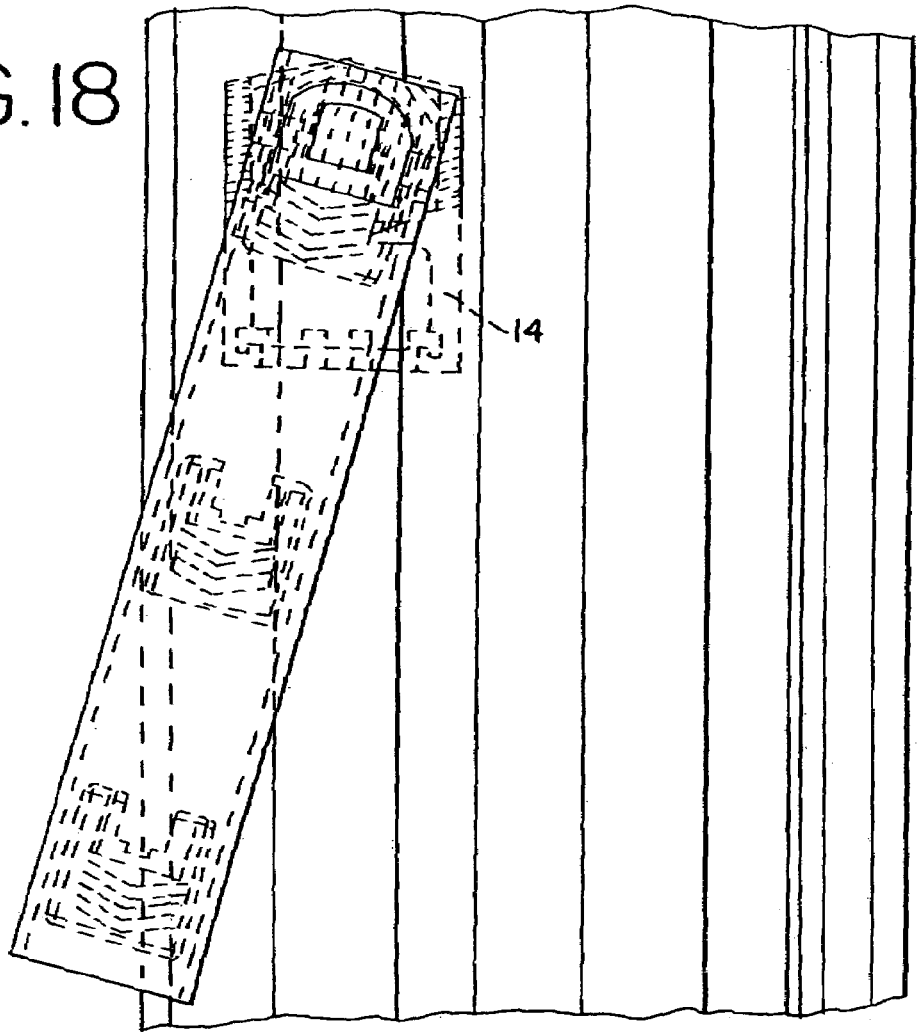
FIG. 18 is a partial view of a window assembly depicting the window at its initial stages of pivoting.

If it is desired to pivot sash 10 out of the plane of the frame 12, such as for washing the rear side of the sash glass, the end of the sash distal from the slider body 14, is freed from the frame and pivoted outwardly to a position such as shown in FIGS. 3, 4, 12 and 14, by rotation of pivot means 60 and cam mechanism 40 of the slider body 14. As discussed the cam 40 and brake members 34,35 include cooperative structure for converting rotary motion of the cam 40 into radial movement of the brake members 34,35 through the side openings 32,33 and axial movement of the cam 40 and slider body 14. During the initial stages of sash 10 rotation, friction pads 76 frictionally engage the adjacent tracks 16 (FIG. 18) to provide initial braking of any sliding movement of the slider bodies 14 prior to full engagement of the four-way braking of the present invention. Through further rotation of sash 10, cam mechanism 40 is rotated causing its substantially circular portions 57 to cooperate with and engage the flat portions 47 of the brake members 34,35 laterally displacing radial brake members 34,35 through the side openings 32,33 whereby the ribbed surfaces 36 are pressed radially outwardly against opposed track sidewalls 20 causing frictional engagement of the same (FIGS. 12 and 14). This radial movement can be realized quicker with the embodiment shown in FIGS. 27 and 28 described below. Upon this displacement, the first and second lips 41 on the brake members 34,35 engage the first and second protuberances 45 (FIG. 19).

Figure 15:
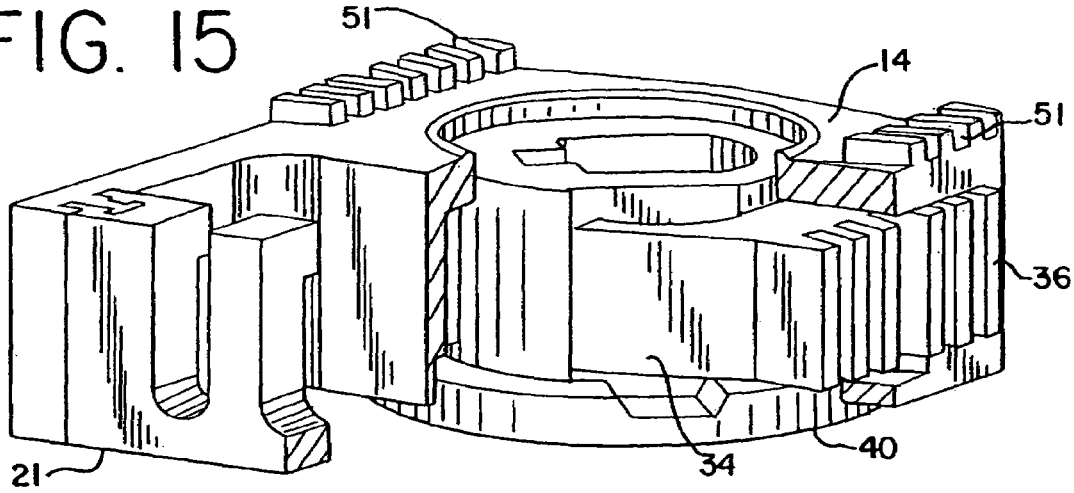
FIG. 15 is a partial cut-away view of the brake shoe with the cam mechanism rotated and showing a radial brake member extending beyond an outer surface of the brake shoe.
Figure 16:
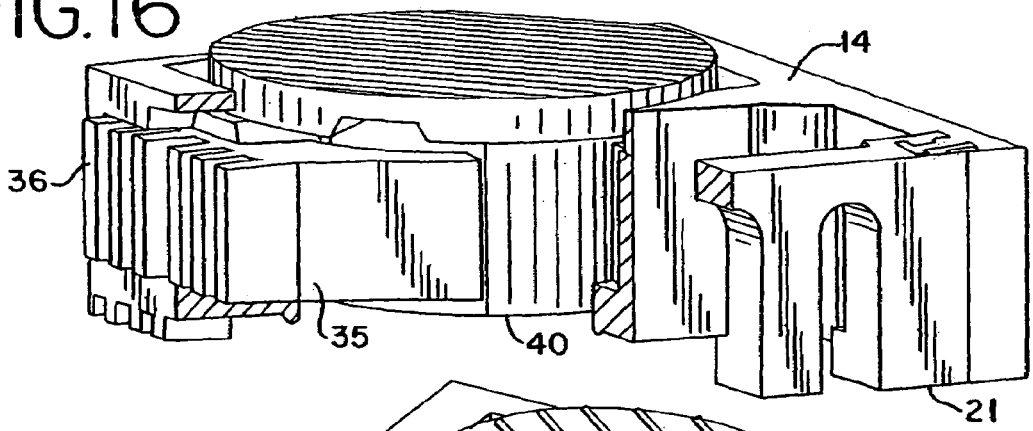
FIG. 16 is a partial cut-away of the brake shoe with the cam mechanism rotated and showing the radial brake member not depicted in FIG. 15 extending beyond an outer surface of the brake shoe.
Figure 17:
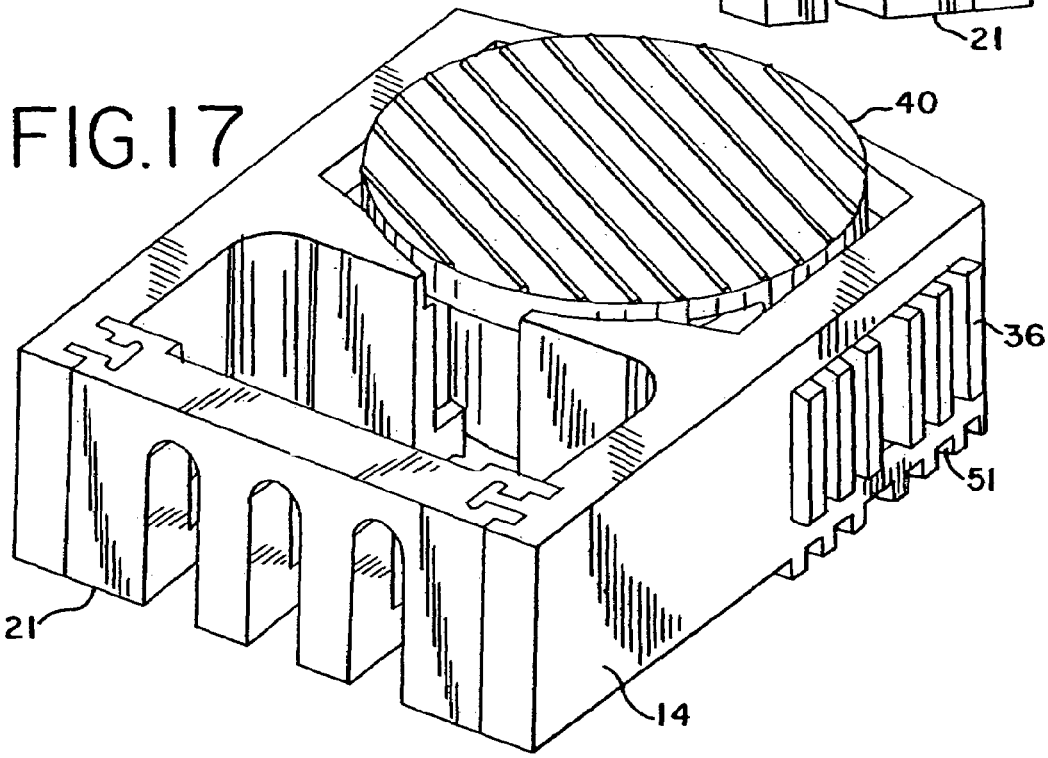
FIG. 17 is a perspective view of the brake shoe showing the radial brake members extended beyond the outer surface of the brake shoe.

This rotation of the cam mechanism 40 also substantially concurrently causes axial biasing of cam mechanism 40 and slider body 14 via interaction of the protrusions 38 moving out of the recesses 48 and engaging the base surface of the flange 46 of the cam 40 such as shown in FIGS. 15–17. In this configuration and as shown in FIG. 14, the friction ribs 51 on the slider body 14 are pressed against the inwardly facing shoulders 22, and cam base elongated ribs 43 are pressed against track base 18 causing frictional abutment or engagement against the opposed elongated base 18 and shoulders 22. This position is defined as a locked window or door position. Thus, the brake assembly 11 is locked against the four inner surfaces of the shoe track 16. It is understood that the placement of the cooperating camming surfaces allow the radial brake members 34,35 to move substantially simultaneously with the axial movement of the cam 40 and slider body 14. Furthermore, it is understood that the braking forces applied to the shoe track 16 by the brake members 34,35, cam 40 and slider body 14 are also simultaneous when in the locked position.

When the sash 10 is rotated back to its slidable position, cam mechanism 40 is rotated such that flats 42 are adjacent to flat portions 47 of brake members 34,35. Protuberances 45 cooperate with lips 41 to provide a resilient biasing force to assist in retracting the radial brake members 34, thereby frictionally releasing ribbed surfaces 36 from opposed track sidewalls 20. In addition, as the cam mechanism 40 is rotated back to its slidable position, the recesses 48 again receive camming protrusions 38 thereby frictionally releasing frictional ribs 51 from inwardly facing shoulders 22 and cam base ridges 43 from the elongated base 18. Thus, the brake assembly 11 is returned to a free sliding position allowing the slider body 14 to slide within track 16.

With reference to FIGS. 5–6, sash installation and removal are facilitated by the device of the invention. Removal of locking tab 62, loosens pivot means 60 in the cam mechanism 40 so that the cam mechanism 40 frees the frictional engagement of the four way braking of the subject invention, such that the sash can be tilted when perpendicular to frame 16 to the position shown in FIG. 2, for removal from the frame. The procedure is reversed for installation of a sash, with locking tab 62 inserted once the sash is positioned perpendicular to tracks 16 of frame 12.

A second preferred embodiment of the present invention is depicted in FIGS. 20–26. Elements of this second embodiment that are similar in structure and function to corresponding elements of the first described embodiment will be referred to with identical reference numerals.

In this second preferred embodiment, the brake shoe assembly 11 utilizes an integral brake shoe element. The radial or lateral brake members 34 are connected by a first, upper resiliently flexible member 239 and a second, or lower resiliently flexible member 241. The integral brake element consisting of brake members 34,35 and flexible members 239,241 is mounted in the slider body 14 such that the brake members 34 are slidably located in the side openings 32,33 and such that the flexible members 239,241 are located within the central opening 28. The cam mechanism 40 is mounted within the central opening 28 such that the flexible members 239 generally surround the cam mechanism 40.

In operation, the window or door sash 10 freely slides horizontally or vertically in the frame 12. If it is desired to pivot sash 10 out of the plane of the frame 12, such as for washing the rear side of the sash glass, the end of the sash distal from the slider bodies, is freed from the frame and pivoted outwardly away from the frame by rotation of the pivot bar 60 and cam mechanism 40 of the upper and lower slider bodies 14 connected thereto. During the initial stages of sash 10 rotation, friction pads 76 frictionally engage outer surfaces of their adjacent tracks 16 to provide initial braking of any sliding movement of slider bodies 14 prior to full engagement of the four-way braking of the present invention. Through further rotation of the sash 10, the cam mechanism 40 is rotated causing its substantially cylindrical surface 57 to cooperate with the inner surface 31 of the brake members 34,35 to laterally displace the brake members 34,35 whereby ribbed surfaces 36 are pressed radially outwardly against opposed track sidewalls 20 causing frictional engagement of the same. The flexible members 239,241 flex to allow radial movement of the brake members 34,35. Rotation of the cam mechanism 40 also substantially concurrently causes axial biasing of the slider body 14 and cam mechanism 40 via interaction of the protrusions 38 leaving the recesses 48 on the cam flange 46 and engaging the base surface of the cam flange 46 whereby frictional ribs 51 are pressed upwardly against inwardly facing shoulders 22, and ridges 43 of the cam 40 are pressed against the elongated base 18 causing frictional engagement of the opposed elongated base 18 and shoulders 22.

When the sash 10 is rotated back to its slidable position, cam mechanism 40 is rotated such that flats 42 are adjacent to planar surfaces allowing the resiliently flexible members 239,241 to bias the radial brake members 34,35 back through the side openings 32,33 to thereby release the ribbed surfaces 36 of the brake members 34,35 from the opposed track sidewalls 20. In addition, the recesses 48 again receive camming protrusions 38 thereby releasing frictional ribs 51 from the inwardly facing shoulders 22 and cam ridges 43 from the track base 18, allowing slider body 14 to slide within the track 16. The flexible members 239,241 provide a resilient biasing force to assist in retracting the brake members 34,35 back through the side openings 32,33.

Figure 27:
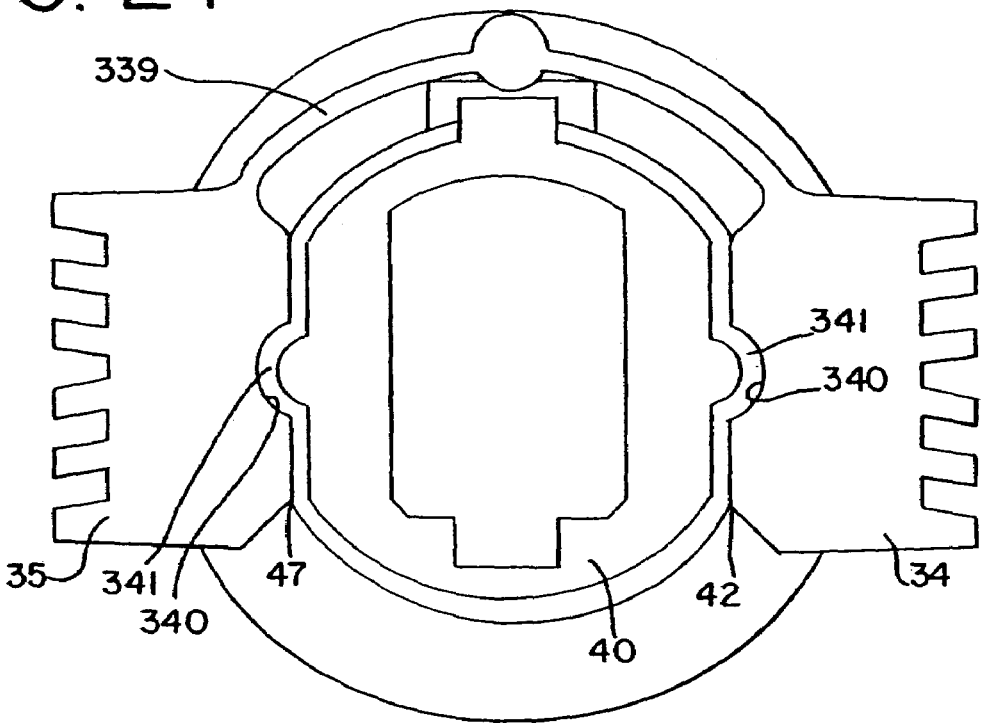
FIG. 27 is a front elevation view of a third preferred embodiment of the invention.
Figure 28:
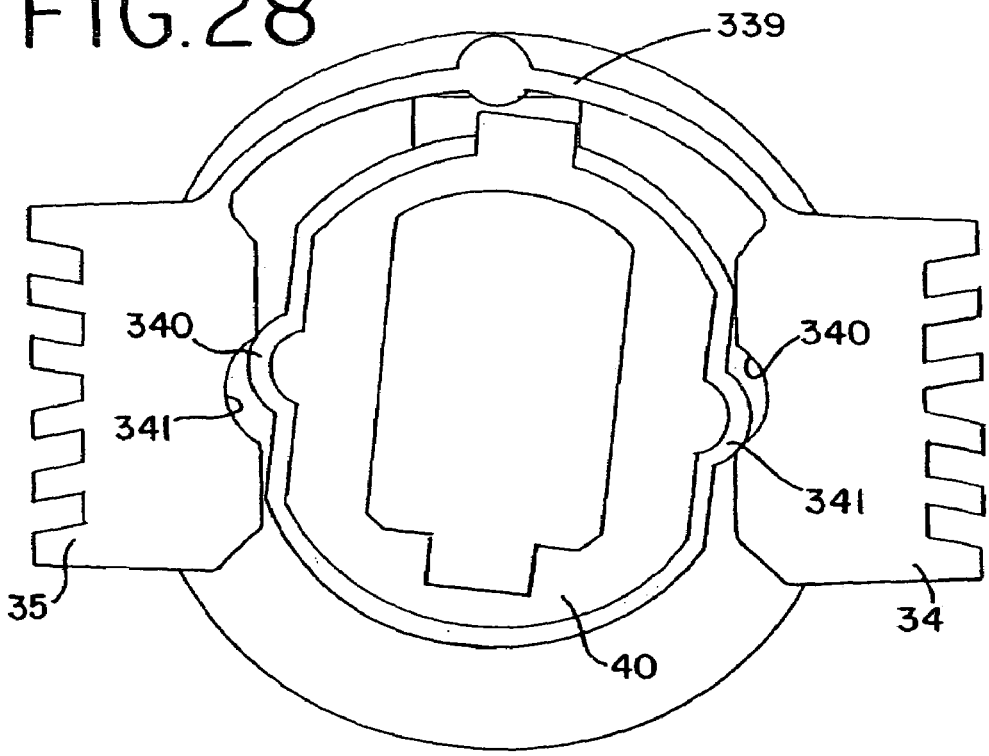
FIG. 28 is a front elevation view of the embodiment of FIG. 27 showing the cam in a rotated position.

A third preferred embodiment of the present invention is depicted in FIGS. 27 and 28. In this third preferred embodiment, the brake members 34,35 of the first preferred embodiment are connected by a single resilient flexible membrane or member 339 to provide an integral brake element. The brake members 34,35 are slidably mounted within respective side openings 32,33. The planar surfaces 47 of the brake members 34,35 each have a radial brake member depression 340 formed therein. In a most preferred embodiment, the depressions 340 are formed at substantially a midportion of the planar surface 47.

In this embodiment, the cam mechanism 40 has a radial protrusion 341 formed on each flat surface 42. In a most preferred embodiment, the radial protrusion 341 is formed at substantially a midportion of the flat surface 42. The cam mechanism 40 is mounted in the central opening 28 such that the flexible member 339 extends around the cam mechanism 40. The radial protrusions 341 are received by the depressions 40 on the brake members 34,35.

The freely-slidable window position of the third embodiment is defined as that position wherein the cam flats 42 abut the flat portions 47 of brake members 34,35, depressions 340 receive the cam radial protuberances 341 and cam flange recesses 48 receive brake member protrusions 38. As shown in FIG. 28, when the cam is rotated as previously described, the cam radial protuberances 341 leave the depressions 340 and engage the flat surfaces 47 of the brake members 34,35 to bias the brake members 34,35 for radial movement, thus resulting in frictional engagement of frictional ribbed surfaces 36 with opposed side walls 20 of track 16. Upon further cam 40 rotation, circular portions 57 of cam 40 engage the flat portions 47 of brake members 34,35 thereby continuing to bias the brake members 34,35 for additional and greater frictional engagement of ribbed surfaces 36 with opposed side walls 20 of track 16. Substantially simultaneous with this radial biasing of brake members 34,35, rotation of cam 40 also causes the brake member protrusions 48 to leave the cam flange recesses 48 resulting in axial biasing of the slider body 14 and cam 40 for frictional engagement of friction ribs 51 with shoulders 22 and for frictional engagement of cam friction ridges 43 with elongated base 18. This position is defined as a locked window position.

It is appreciated that the position of the cam radial protrusions 341 and depressions 340 on the brake members 34,35 provide extremely quick movement of the brake members 34,35 upon rotation of the cam 40. For example, radial braking can be realized upon 10 degrees of rotation of the cam 40. In a most preferred embodiment, maximum radial braking is accomplished upon as little as 5 degrees of rotation of the cam 40. In other prior art designs, maximum braking is not accomplished until 30–90 degrees of rotation of the cam member. In addition, with prior art designs, the braking force was reduced if the cam was rotated greater than 90 degrees because of the flat surfaces on opposite sides of the cam. This does not occur with the present invention as even if the cam 40 is rotated greater than 90 degrees, the protrusions 341 will prevent the brake members 34,35 from moving away from the shoe track 16 and reducing the braking force. It is further understood that the location of the camming surfaces between the brake members 34,35 and cam 40 for axial braking allows for axial braking to be accomplished very quickly.

Upon rotation of the cam 40 back to its freely-slidable window position, resilient flexible member 339 provides a resilient biasing force to assist in retracting the brake members 34,35 to their freely-slidable window position wherein the frictional ribbed surfaces 36 of the brake members 34,35 are released from the opposed side walls 20.

It is understood that the camming feature of the third embodiment represented by depression 340 and protuberance 341, can be incorporated into any of the other embodiments described herein. Also, the pairs of camming surfaces described herein can be respectively reserved. For example, it is herein described that brake members 34,35 have a protrusion 38 located on their rear surface and the cam flange 46 has a corresponding recess 48. It is possible to reverse these surfaces and place protrusion 38 on the cam flange 46 and the recess 38 on the brake members 34. Likewise all the features of the several embodiments described herein can be combined as desired to achieve the desired results.

The present invention provides a number of important advantages. The four-way braking described above results in much more secure braking, which is more quickly realized, than that presently available in the prior art. Window sashes and doors can be pivoted out of the plane of a frame, such as for washing, while safely restrained in the frame. Furthermore, by pivoting the window as little as 5 degrees, brake movement and frictional abutment of the braking surfaces with the shoe track can be commenced and accomplished. If desired, the sash can be easily removed from the frame by removal of a locking tab. The connecting portion of the pivot means for joining the sash to the sliding mechanism is hidden from access by intruders and can be detached from the sash only when the sash is removed from the frame. The pivoting and sliding device is simple in design and reliable and trouble-free in operation. The frictional ribs on the slider body 14, cam mechanism 40 and brake members 34 provide increased frictional properties. Also, the friction pad 76 provides initial braking when the sash or door is pivoted. Finally, the structure and position of the cooperating cam surfaces between the cam 40 and brake members 34,35 allow for substantially simultaneous, or concurrent movement of the slider body 14, brake members 34,35, and cam 40 to achieve substantially simultaneous, or concurrent four-way locking against the four inner faces of the track 16 more quickly.

While the specific embodiments and various details thereof have been illustrated and described, numerous modifications come to mind without significantly departing from the spirit of the invention and the scope of protection is only limited by the scope of the accompanying claims.

What is claimed is:

1. A brake assembly for locking a slidable sash window or door within a track of a frame, the track having an elongated base and a pair of spaced apart, opposed sidewalls extending perpendicular from the base, each sidewall having an inner shoulder spaced from and parallel to the base, the assembly comprising:

a slider body having a central opening, a side opening in the slider body being in communication with the central opening;

a brake member slidably positioned within the side opening, the brake member having an inner surface;

a cam adapted to receive a pivot member mounted on either the sash window or door, the cam positioned in the central opening and adapted to be rotatable within the central opening by the pivot member, the cam having an outer surface, wherein either the brake member inner surface or the cam outer surface has a depression and the other has a protuberance received by the depression to define a slidable position, where upon rotation of the cam causes the protuberance to be displaced out of the depression to radially bias the brake member through the side opening to define a locked position.

2. The brake assembly of claim 1 wherein the inner surface has a flat portion formed therein and the outer surface has a flat portion formed therein wherein the protuberance and depression are respectively formed in either the inner surface flat portion or the outer surface flat portion.

3. The brake assembly of claim 2 wherein the protuberance and the depression are respectively located at a mid portion of either the inner surface flat portion or the outer surface flat portion.

4. The brake assembly of claim 1 wherein the inner surface has a flat portion and the outer surface has a flat portion and a curved portion, where upon rotation of the cam causes the outer surface curved portion to engage the inner surface flat portion to radially bias the brake member through the side opening to further define the locked position.

5. A brake assembly for locking a slidable sash window or door within a track of a frame, the track having an elongated base and a pair of spaced apart, opposed sidewalls extending perpendicular from the base, each sidewall having an inner shoulder spaced from and parallel to the base, the assembly comprising:

a slider body having a central opening extending from a front face of the body to a rear face of the body, a side opening in the slider body being in communication with the central opening;

a brake member slidably positioned within the side opening, the brake member having an inner surface, the inner surface having a depression;

a cam having a rear face and a front face adapted to receive a pivot member mounted on either the sash window or door, the cam positioned in the central opening and adapted to be rotatable within the opening by the pivot member, the cam having an outer surface having a protuberance received by the depression;

where upon rotation of the cam causes the protuberance to be displaced out of the depression to radially bias the brake member through the side opening.

6. The brake assembly of claim 5 wherein the depression is formed in a flat portion formed on the inner surface and the protuberance is formed in a flat portion formed on the outer surface.

7. The brake assembly of claim 6 wherein the protuberance is located proximate a mid-point of the outer surface flat portion and the depression is located proximate a mid-point of the inner surface flat portion.

8. The brake assembly of claim 5 wherein the cam outer surface has a curved portion, where upon rotation of the cam causes the outer surface curved portion to engage the inner surface flat portion to radially bias the brake member through the side opening to further define the locked position.

9. A brake assembly for locking a slidable sash window or door within a track of a frame, the track having an elongated base and a pair of spaced apart, opposed sidewalls extending perpendicular from the base, each sidewall having an inner shoulder spaced from and parallel to the base, the assembly comprising:

a slider body having a central opening extending from a front face of the body to a rear face of the body, a side opening in each side of the slider body and being in communication with the central opening;

a pair of brake members, one brake member slidably positioned within a respective one of the side openings, each brake member having an inner surface with a flat portion formed therein;

a cam having a rear face and a front face, the cam adapted to receive a pivot member mounted on either the sash window or door, the cam positioned in the central opening and adapted to be rotatable within the central opening by the pivot member, the cam further having an outer surface with a pair of flat portions and curved portions formed therein; and the cam and brake members including cooperative means for converting rotary motion of the cam into radial movement of the brake members through the side openings and cooperative means for converting rotary motion of the cam into axial movement of the cam and slider body;

wherein the cooperative means for converting rotary motion of the cam into radial movement of the brake members is positioned proximate a mid-point of the flat portion of the inner surfaces and a mid-point of the flat portions of the outer surface.

10. The brake assembly of claim 9 wherein the brake members have a rear surface and the cam has a flange having a flange surface in opposed relation to the rear surfaces and the cooperative means for converting rotary motion of the cam into axial movement of the cam and slider body comprises one of:

(1) a protrusion located on each rear surface and a pair of recesses located on the flange surface, and (2) a recess located on each rear surface and a pair of protrusions located on the flange surface, where upon rotation of the cam, the protrusions leave the recess for axial biasing of the slider body away from the cam.

11. The brake assembly of claim 10 wherein the protrusions are located on the rear surfaces and the side openings have a slot adapted to receive the protrusions.

12. The brake assembly of claim 9 wherein the cooperative means for converting rotary motion of the cam into radial movement of the brake members comprises a depression formed in the flat portions of each brake member inner surface and a protuberance formed in each flat portion of the cam outer surface, the depressions adapted to receive a respective protuberance, whereupon rotation of the cam causes the protuberance to be displaced out of the depression for radial movement of the brake members.

* * * * *